US008429923B2

(12) United States Patent
Iguchi et al.

(10) Patent No.: US 8,429,923 B2
(45) Date of Patent: Apr. 30, 2013

(54) LOW TEMPERATURE SHOWCASE

(75) Inventors: Harunobu Iguchi, Ota (JP); Keisuke Yamazawa, Tatebayashi (JP); Tatsuya Itabashi, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 937 days.

(21) Appl. No.: 12/499,303

(22) Filed: Jul. 8, 2009

(65) Prior Publication Data

US 2010/0043472 A1 Feb. 25, 2010

(30) Foreign Application Priority Data

Aug. 21, 2008 (JP) ..... 2008-212618

(51) Int. Cl.
*A47F 3/04* (2006.01)
*F25B 47/00* (2006.01)

(52) U.S. Cl.
USPC ..... 62/255; 62/277; 62/248

(58) Field of Classification Search ..... 62/248, 62/255, 277; 49/DIG. 1
See application file for complete search history.

(56) References Cited

U.S. PATENT DOCUMENTS 1,847,109 A * 3/1932 Holbrook ..... 62/277
4,009,586 A * 3/1977 Skvarenina ..... 62/80

FOREIGN PATENT DOCUMENTS

JP 9-101075 4/1997
JP 2000-227271 8/2000
JP 2002-364974 12/2002

* cited by examiner

*Primary Examiner* — Frantz Jules
*Assistant Examiner* — Cassey D Bauer
(74) *Attorney, Agent, or Firm* — Kratz, Quintos & Hanson, LLP

(57) ABSTRACT

An object is to provide a low temperature showcase in which waste heat from a condenser and the like can be utilized by a simple constitution to effectively eliminate dew condensation on a middle pillar, particularly on gasket of upper part of a door. The low temperature showcase includes a middle pillar whose front surface abuts on the gasket of the door; a machine chamber disposed outside a main body under a display chamber and including the condenser, a fan for the condenser and the like, and the showcase further includes a middle pillar duct member which is vertically attached to the middle pillar and in which a middle pillar duct is defined, a leading portion which leads air from the machine chamber into the middle pillar duct, and exhaust holes which discharge the air flowing upwards through the duct to the outside of the gasket between the upper part of the door and the main body.

2 Claims, 12 Drawing Sheets

LOW TEMPERATURE SHOWCASE

BACKGROUND OF THE INVENTION

The present invention relates to a low temperature showcase in which an opening in the front surface of a display chamber is openably closed with doors.

A conventional type of low temperature showcase is installed in a store such as a convenience store or a supermarket, and an opening in the front surface of an insulating box member having a display chamber in the showcase is closed with doors (e.g., glass doors) (e.g., see Japanese Patent Application Laid-Open No. 9-101075 (Patent Document 1)). Moreover, a machine chamber is disposed under the insulating box member, and a compressor, a condenser, a fan for the condenser and the like are arranged in this machine chamber so as to form a freezing cycle of a cooling device. Moreover, a cooler similarly forming the freezing cycle is disposed in the display chamber, and the inside of the display chamber is cooled to a predetermined low temperature by this cooler.

Moreover, a middle pillar is provided in the opening of the front surface of the display chamber. This middle pillar can closely be attached to a gasket attached to the inner surfaces of, for example, hinged double doors, whereby sealing properties in the display chamber during the closing of the doors are maintained.

Here, the structure of a conventional low temperature showcase 100 will be described with reference to FIGS. 10 to 12. FIG. 10 is perspective view of the conventional low temperature showcase 100 from which doors are removed, FIG. 11 is a sectional plan view of the low temperature showcase 100, and FIG. 12 is an enlarged view of a circular D part of FIG. 11.

A main body of the low temperature showcase 100 is defined by an insulating box member 101 having an openable front surface, and a display chamber 102 is formed in the insulating box member 101. Moreover, a machine chamber is formed under this insulating box member 101, and the front surface of the machine chamber is openably closed with a front surface panel 103.

Hinged double doors 106, 106 are provided in an opening in the front surface of the display chamber 102. Gaskets 107 including magnetic members (magnets) 107M are attached to the back surface of the peripheral edge of the doors 106. Moreover, a middle pillar 105 is vertically provided in the form of a post which vertically extends in, for example, the center of a front surface opening 104 of the display chamber 102. Furthermore, a front surface 105A of the middle pillar 105 is closely attached to the gasket 107 on the rear surface of the side end of the glass door 106 on an open side by the magnet 107M provided in the gasket 107 of the glass door 106, whereby the display chamber 102 is closed.

Here, as shown in FIG. 12, the middle pillar 105 includes a rear panel 108 formed so as to vertically extend, a front panel 109 (made of a metal) and breakers 110, 110 which are made of a resin and which connect the panel 108 to the panel 109, and an insulating material 111 is foamed and charged into a space surrounded with the panels 108, 109 and the breakers 110, 110.

However, when the inside of the display chamber 102 is cooled, the middle pillar 105 itself and frames of the glass doors 106 are exposed to cold air. Therefore, dew condensation occurs on the front surface 105A of the middle pillar 105 and the surfaces of the gaskets 107 of the glass doors 106, because the surfaces come in contact with outside air. When such dew condensation occurs, a disadvantage is generated that fingers for opening/closing the glass doors 106 are wetted by dew condensation water attached to the middle pillar 105 and the like during the opening/closing of the glass doors 106 or that clothes are wetted by bounding dew condensation water during the opening/closing operation. Furthermore, there is generated a disadvantage that water droplets attached to the glass doors 106 due to the dew condensation drop down to wet the surface of an installation floor.

In consequence, to prevent the generation of the dew condensation water, an electric heater (a cord heater) is disposed so as to abut on the rear surface of the front panel 109 closely attached to the rear surface of the side end of the glass door 106 on the open side and so as to perform heat exchange between the heater and the surface of the front panel. When the electric heater is energized, the front panel 109 of the middle pillar 105 is heated to suppress the generation of the dew condensation on the glass doors 106, the gaskets 107 and the front surface 105A of the middle pillar.

However, the heating by such an electric heater is usually performed by the energization. Therefore, the power consumption of the showcase itself increases, and the steep rise of running cost is disadvantageously caused. Moreover, the electric heater is disposed in the insulating material 111 of the middle pillar 105, and hence when a defect such as the disconnection of the heater occurs during an operation step, repair cannot be performed.

In consequence, the present invention has been developed to solve the conventional technical problem, and an object thereof is to provide a low temperature showcase in which waste heat from a condenser and the like can be utilized by a simple constitution to effectively eliminate dew condensation on a middle pillar, particularly on a gasket of an upper part of a door.

SUMMARY OF THE INVENTION

A low temperature showcase of a first invention of the present application is characterized by including a display chamber disposed in a main body made of an insulating wall; doors which have gaskets closely attached to the opening edge of the front surface of this display chamber and which openably close the opening of the front surface of the display chamber; a middle pillar which is provided in the opening of the display chamber and whose front surface abuts on the gaskets of the doors; a machine chamber disposed outside the insulating wall under the display chamber; and a cooling unit constituted of a compressor, a condenser, a fan for the condenser and the like arranged in this machine chamber, the showcase including: a middle pillar duct member which is vertically attached to the middle pillar and in which a middle pillar duct is defined; a leading portion which leads air discharged from the fan for the condenser into the middle pillar duct; and exhaust holes which discharge the air flowing upwards through the middle pillar duct to the outside of the gaskets between the upper parts of the doors and the main body.

Moreover, a low temperature showcase of a second invention of the present application is characterized in that in the above invention, a plurality of exhaust holes are provided in the middle pillar duct member, and upper exhaust holes have larger open areas.

Furthermore, a low temperature showcase of a third invention of the present application is characterized in that in the above inventions, the middle pillar duct member is provided on the front surface of the middle pillar.

According to the above first invention, the low temperature showcase is provided with the display chamber disposed in the main body made of the insulating wall, the doors which include the gaskets closely attached to the opening edge of the front surface of this display chamber and which openably close the opening of the front surface of the display chamber, the middle pillar which is provided in the opening of the display chamber and whose front surface abuts on the gaskets of the doors, the machine chamber disposed outside the insulating wall under the display chamber, and the cooling unit made of the compressor, the condenser, the fan for the condenser and the like arranged in this machine chamber. Such a low temperature showcase includes the middle pillar duct member which is vertically attached to the middle pillar and in which the middle pillar duct is disposed, the leading portion which leads the air discharged from the fan for the condenser into the middle pillar duct, and the exhaust hole which discharges the air flowing upwards through the middle pillar duct to the outside of the gaskets between the upper parts of the doors and the main body. Therefore, warm air (waste heat) led from the machine chamber into the middle pillar duct through the leading portion can directly be discharged externally from the gaskets between the upper parts of the doors and the main body. In consequence, the gaskets between the door upper parts and the main body can be heated by the warm air, and the dew condensation does not easily occur on the gaskets provided on the upper parts of the doors and the surface of the middle pillar around the gaskets.

Therefore, it is possible to suppress a disadvantage that water droplets attached to the upper parts of the doors fly and scatter to a user during the opening/closing operation of the doors or that a floor surface is wetted by the water droplets. Moreover, in this corresponding part, dew condensation water is not easily attached to the surface of the middle pillar, whereby the closely attaching properties to the back surfaces of the doors can be improved, and the leakage of the cold air from the display chamber can be suppressed.

Moreover, according to the second invention, in the above invention, the plurality of exhaust holes are provided in the middle pillar duct member, and the upper exhaust holes have larger open areas. Therefore, the upper exhaust hole which is disposed apart from the machine chamber and which cannot easily be reached by the warm air can more efficiently discharge the warm air, and the dew condensation does not easily occur on the gaskets provided on the upper parts of the doors, and the surface of the middle pillar around the gaskets.

Furthermore, according to the third invention, in addition to the above inventions, the middle pillar duct member is provided on the front surface of the middle pillar. Therefore, the middle pillar duct member provided on the front surface of the middle pillar can be heated by the heat conducted from the warm air discharged from the fan for the condenser and flowing upwards through the middle pillar duct.

In consequence, the dew condensation does not easily occur vertically on the surface of the middle pillar duct member which comes in contact with outside air. Therefore, the dew condensation does not easily occur even on the gaskets of the doors which abut on the front surface of the middle pillar duct member, and it is possible to suppress a disadvantage that fingers are wetted during the opening/closing operation of the doors or that the floor surface is wetted by the water droplets attached to the back surfaces of the doors. Moreover, the dew condensation water is not easily attached to the surface of the middle pillar, whereby the closely attaching properties of the front surface of the middle pillar to the gaskets of the doors can be improved, and the leakage of the cold air from the display chamber can be suppressed.

DETAILED DESCRIPTION OF THE PREFERRED EMBODIMENT

Figure 1:
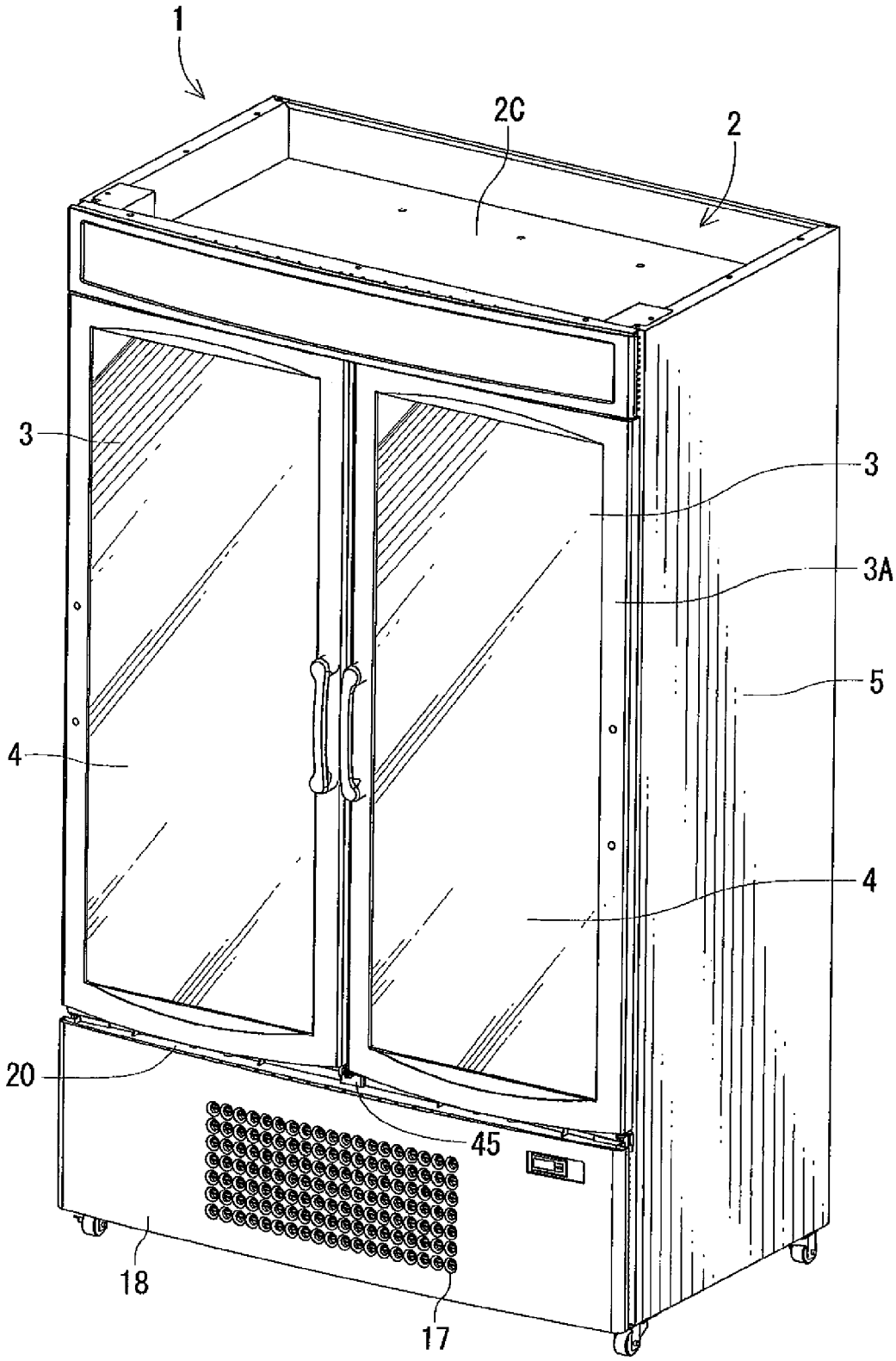
FIG. 1 is a perspective view of a low temperature showcase to which the present invention is applied.
Figure 2:
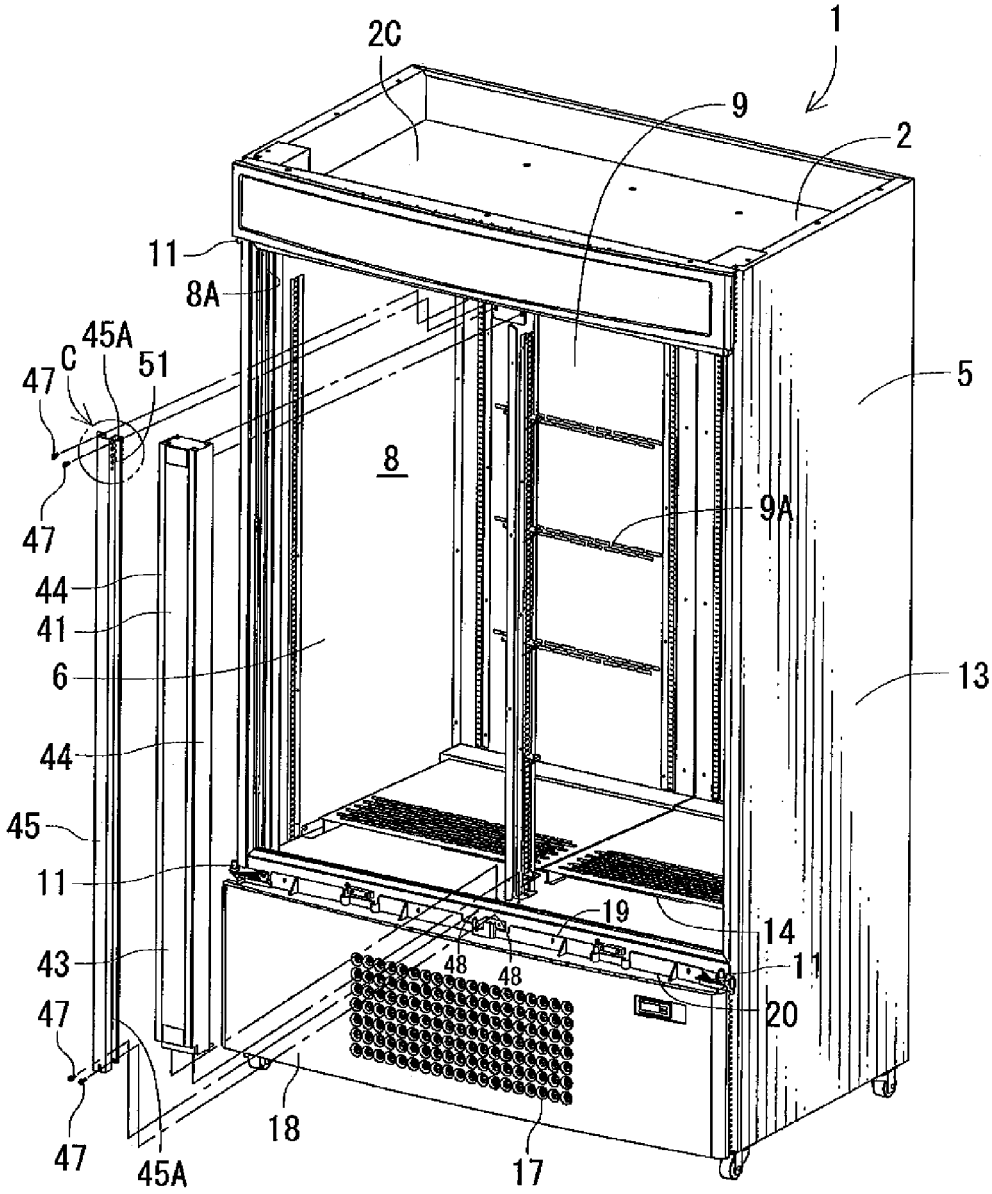
FIG. 2 is an exploded perspective view of a part of the showcase from which doors of FIG. 1 are removed.

Next, an embodiment of the present invention will be described with reference to the drawings.

A showcase 1 of the present embodiment is a low temperature showcase which is installed in a store such as a supermarket or a convenience store and which displays commodities while cooling the commodities, and a main body 2 is made of an insulating box member (an insulating wall) having an opening in the front surface thereof. This main body 2 includes an outer box 5 which opens in the front surface of the main body and which is made of a steel plate; an inner box 6 which is incorporated in the outer box 5 with a space being left from the front surface of the main body and which opens in the front surface of the main body and which is made of a steel plate or a hard synthetic resin; and an insulating material 7 made of foam polyurethane charged between the outer box 5 and the inner box 6 in a foaming state. It is to be noted that in the present embodiment, at the upper edge of the opening in the front surface of the main body 2, the front end of a top wall 2C extends downwards as much as a predetermined dimension.

Moreover, a display chamber 8 opening forwards is formed in the inner box 6, and a front surface opening (an opening) 8A is openably closed by hinged double doors 3, 3 having glass 4 through which the inside can be seen. Each door 3 is supported rotatably around one side of the main body 2 by a hinge member 11.

A base leg angle 12 having a predetermined height is attached to the bottom surface of the main body 2, and both side surfaces of this base leg angle 12 together with both side surfaces of the main body 2 are covered with decorative panels 13. In consequence, a machine chamber 21 having an upward opening is formed outside the insulating wall under the main body 2. Moreover, a cold air suction port 14 and a cold air discharge port 15 are formed in front and rear portions of a bottom wall 2A of the main body 2, respectively, so as to extend through the outer box 5.

A cooling box 22 having an opening in the upper surface thereof is provided so as to abut on the lower surface of the bottom wall 2A of the main body 2 as a ceiling of the machine chamber 21. A cooling chamber 23 is formed in this cooling box 22, and a cooler 24 of a cooling device is disposed in the cooling chamber. A fan 25 for the cooler is disposed before the cooler 24. It is to be noted that an upper surface opening of this cooling box 22 is provided with a cold air suction port 27 and a cold air discharge port 28 on the side of the cooling box 22. The cold air suction port 27 and the cold air discharge port 28 correspond to the cold air suction port 14 and the cold air discharge port 15 formed in the bottom wall 2A of the main body 2, respectively.

On the other hand, in a back wall 2B of the main body 2, a partition plate 9 is attached so as to dispose a duct 10 which connects the cold air discharge port 15 formed in the bottom wall 2A to the upper part of the display chamber 8. An upper end of this partition plate 9 is provided with a cold air discharge port 16 for supplying cold air discharged from the fan 25 for the cooler, and the partition plate 9 attached to the back surface of the display chamber 8 is provided with a plurality of openings 9A.

On the other hand, in the machine chamber 21, a cooling unit R and the like are provided, the cooling unit including a compressor 33 which has a refrigerant circuit of a freezing cycle together with the cooling unit 24, a condenser 34 and a fan 35 for the condenser which forwards air to the condenser and the like.

Moreover, the front surface of the machine chamber 21 is openably closed with a machine chamber cover 18 provided with a plurality of suction ports 17. This machine chamber cover 18 is formed so as to extend from the opening edge of the front surface of the machine chamber 21 to a part under the doors 3. As shown in a partially enlarged view in FIG. 7, the front surface of the machine chamber cover 18 is provided with a plurality of exhaust ports (blowout portions) 19 which open upwards at positions corresponding to lower portions of the front surface opening (the opening) 8A of the display chamber 8 and which extend horizontally (in a longitudinal direction). Moreover, before the exhaust ports 19, a dew receiving portion 24 is formed in a portion lower than the opening edges of the exhaust ports 19.

Figure 3:
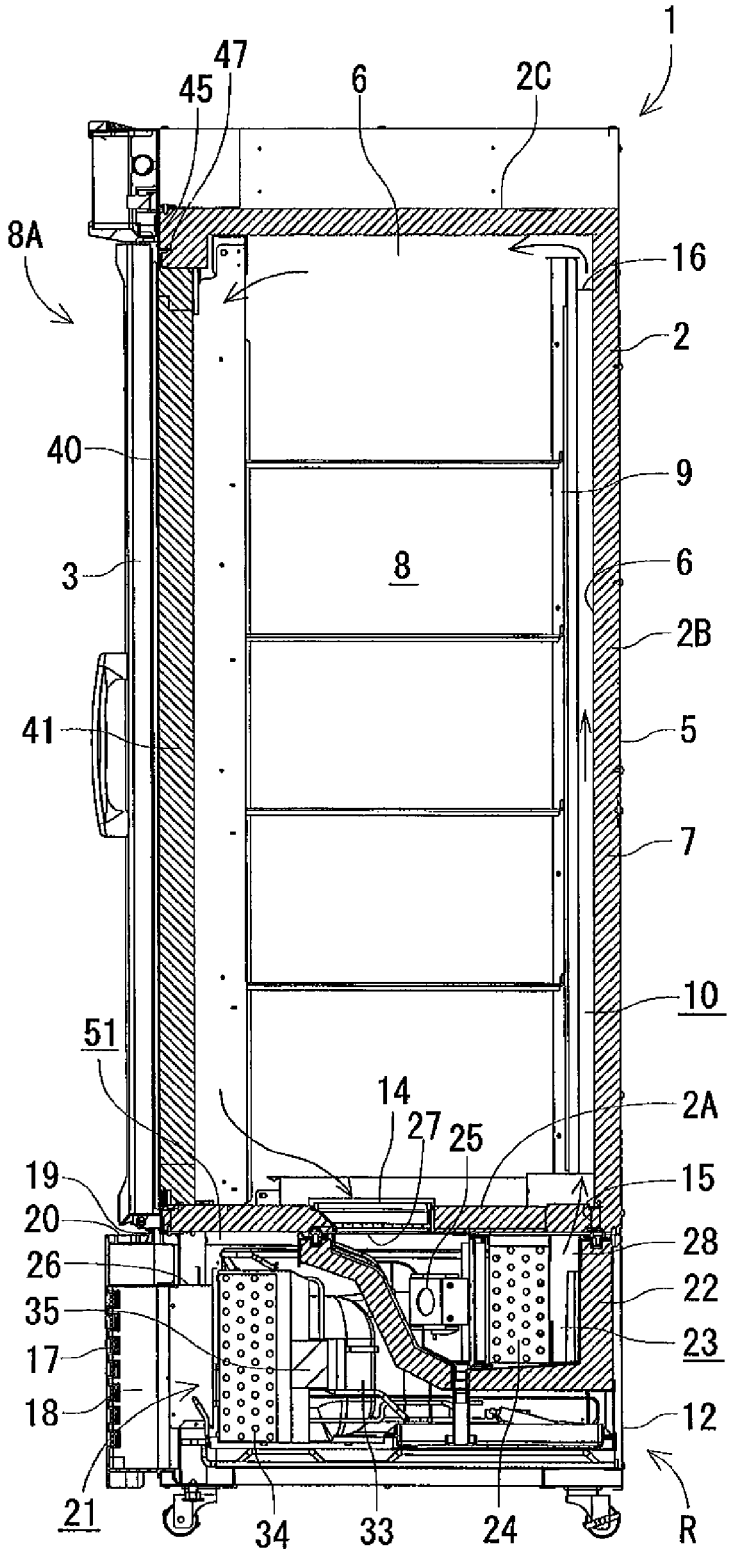
FIG. 3 is a vertical side view of FIG. 1.
Figure 4:
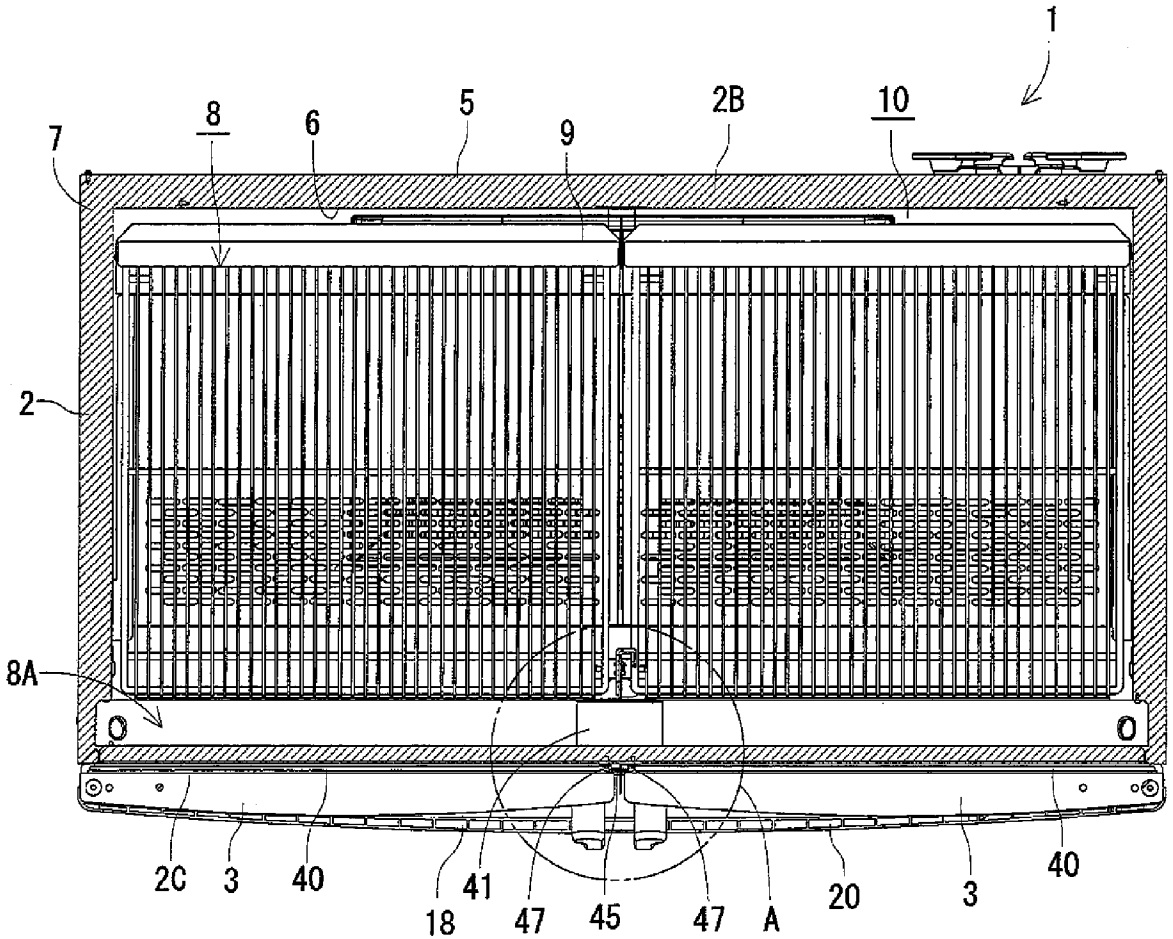
FIG. 4 is a lateral plan view of FIG. 1.
Figure 5:
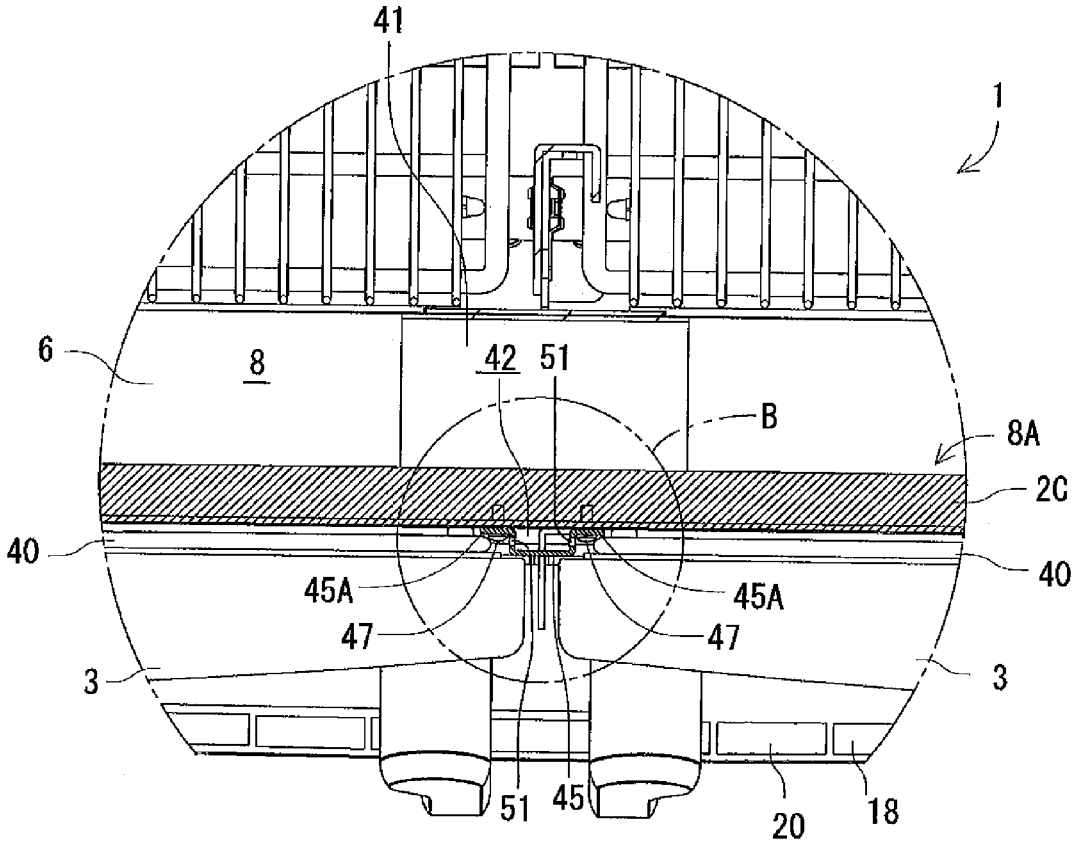
FIG. 5 is an enlarged view of a circular A part of FIG. 1.

Moreover, the fan 35 for the condenser disposed in the machine chamber 21 is provided with a fan case 26 attached over the upper end of the condenser 34 positioned before the fan 35 for the condenser (i.e., on the side of the machine chamber cover 18 corresponding to an air suction side) (see FIG. 3). The front end of this fan case 26 extends to the back surface of the machine chamber cover 18 positioned above the suction ports 17, whereby a part of air sucked from the suction ports 17 and heated by the waste heat of the condenser 34 is discharged upwards from the exhaust ports 19 through an exhaust duct 51 formed between the fan case 26 and the bottom wall 2A of the main body 2. It is to be noted that in the present embodiment, the fan case 26 is formed so as to extend to the back surface of the machine chamber cover 18, but the present invention is not limited to this embodiment, and the fan case may be made of two or more partition plates or the like as long as the exhaust duct 51 can be disposed.

Next, the constitution of each door 3 will be described. The door 3 includes a door frame 3A made of, for example, a hard synthetic resin, the transparent double glass 4 fitted into the door frame 3A and a gasket 40 attached around the inner surface of the door frame 3A (the surface on the side of the display chamber 8). The door frame 3A attached to the lower side of the door 3 is provided with a plurality of ventilating holes (not shown) extending through the frame in a vertical direction, and the ventilating holes open outside the glass 4 (on a side opposite to the display chamber 8 side). Moreover, in the gasket 40, a magnet as a magnetic member is provided so that the magnet is closely attached to the front surface opening edge 8A of the display chamber 8.

Moreover, in the present embodiment, the hinged double doors substantially having an equal dimension are disposed, and hence a middle pillar 41 is substantially vertically disposed in the center of the opening 8A of the main body 2 so that the gasket 40 vertically positioned in the center between the doors 3 abuts on the middle pillar. As shown in a perspective view in FIG. 3, the middle pillar 41 includes a rear panel (not shown) made of a metal and formed so as to vertically extend, a front panel 43 and breakers 44, 44 made of a resin and connecting the rear panel to the front panel. An insulating material is foamed and charged into a space surrounded with the rear panel, the panel 43 and the breakers 44. The front surface of the front panel 43 made of a metal material substantially has the same plane as that of the front ends of both the breakers 44.

Figure 7:
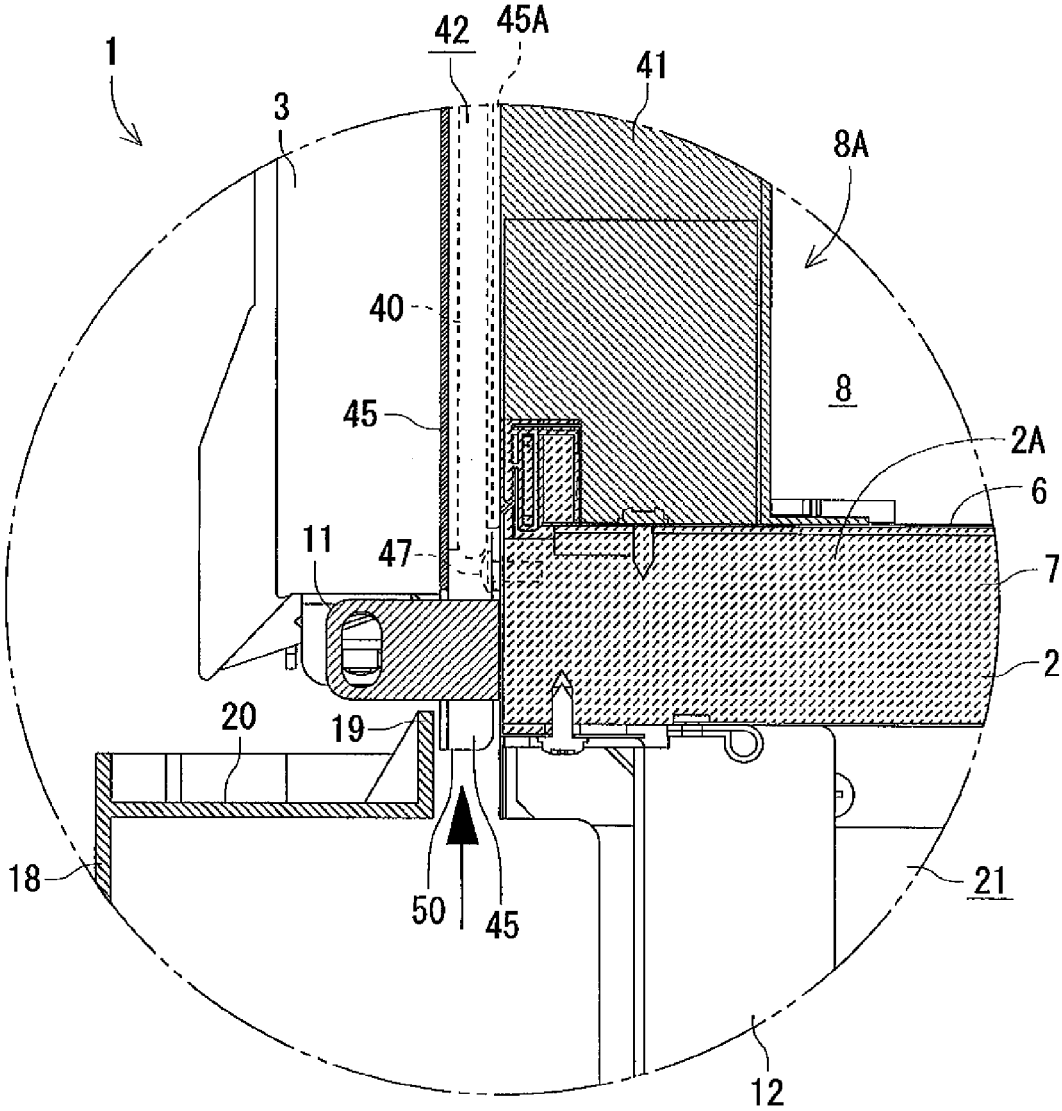
FIG. 7 is an enlarged sectional view of a lower part of the showcase of FIG. 3.
Figure 8:
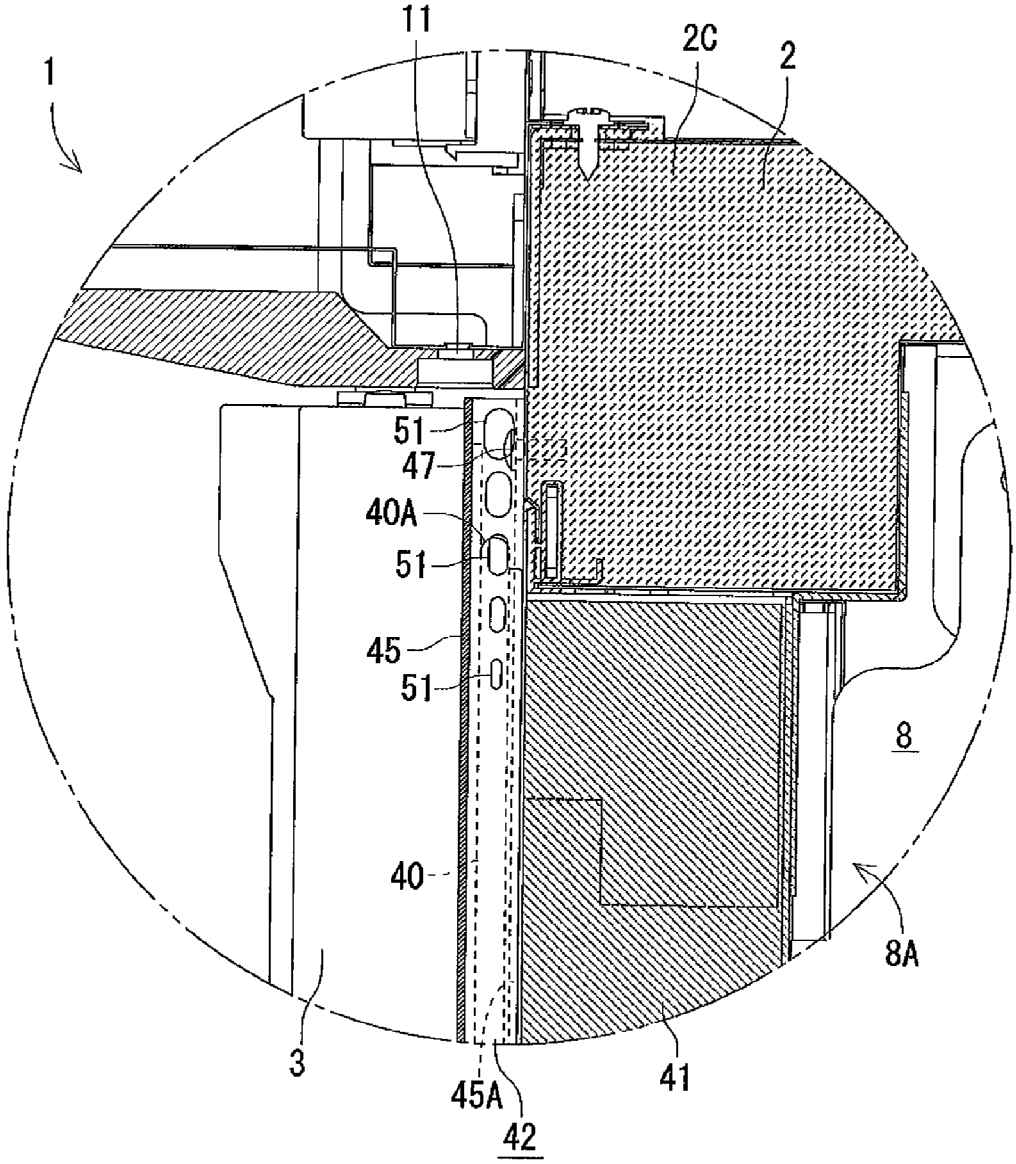
FIG. 8 is an enlarged sectional view of an upper part of the showcase of FIG. 3.

Furthermore, a middle pillar duct member 45 forming a middle pillar duct 42 between the duct member and the front surface of the middle pillar 41 is attached to a position corresponding to the front surface of this middle pillar 41. The middle pillar duct member 45 is made of a material through which at least the front panel 43 is closely attached to the magnet of the gasket 40 owing to a magnetic force, for example, a steel-plate-like material. As shown in FIG. 8, the upper end of the duct member extends to the front surface of the top wall 2C of the main body 2 above at least an upper side 40A of the gasket 40 of the door 3, that is, above the upper edge of the door 3 in the present embodiment. Moreover, as shown in FIG. 7, the lower end of the duct member extends to the front surface of the bottom wall 2A of the main body 2, or extends into the exhaust ports 19 formed in the machine chamber cover 18 below the front surface of the bottom wall.

In the present embodiment, the lower end of the middle pillar duct member 45 is provided with a leading portion 50 which opens in the exhaust ports 19 of the machine chamber cover 18, and the air discharged from the machine chamber 21 through the exhaust ports 19 can flow into the middle pillar duct 42 through the leading portion 50.

Figure 6:
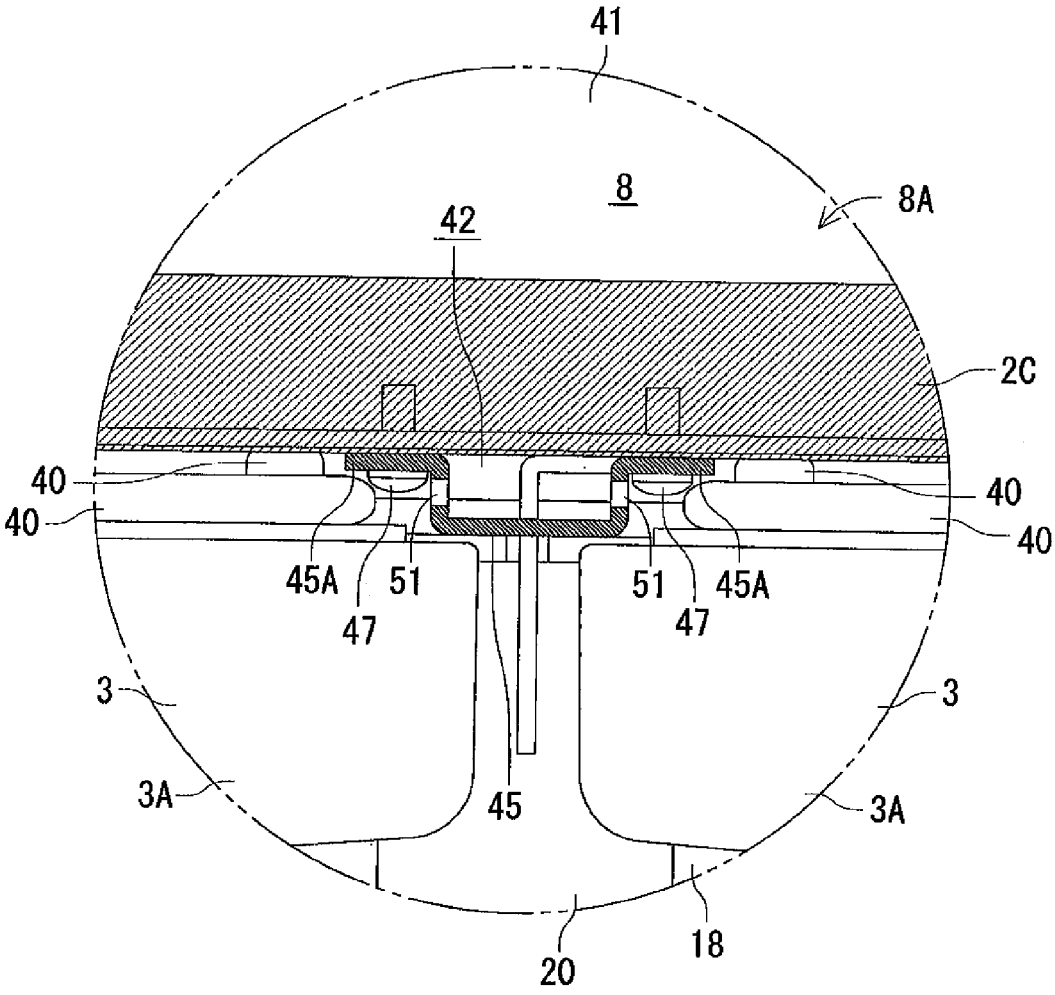
FIG. 6 is an enlarged view of a circular B part of FIG. 5.

Moreover, as shown in FIG. 6, this middle pillar duct member 45 is provided in a position where the gaskets 40 of both the doors 3 are avoided. The section of the middle pillar duct member of the middle pillar duct member substantially has a U-shape having such a dimension that the section can be received in a gap between the rear surface of the door frame 3A and the front surface of the top wall 2C of the main body 2, the front surface of the middle pillar 41 or the front surface of the bottom wall 2A while the doors 3 are closed. The section opens rearwards (on the side of the middle pillar 41. Both side ends of the middle pillar duct member are flanges 45A, 45A bent outwardly.

The back surfaces of these flanges 45A, 45A can abut on the front surface of the top wall 2C of the main body 2, the front surface of the middle pillar 41 and the front surface of the bottom wall 2A. Screw holes 46 for fixing the flanges by screws are formed in positions where the back surfaces of the flanges abut on the front surface of the top wall 2C and the front surface of the bottom wall 2A. Therefore, the upper end of the middle pillar duct member 45 is fixed by screws 47, when screw holes (not shown) formed in the front surface of the top wall 2C are superimposed on screw holes 46 of the middle pillar duct member 45 and the screws are inserted through the screw holes. The lower end of the middle pillar duct member 45 are fixed by screws 47, when screw holes 48 formed in the front surface of the bottom wall 2A are superimposed on screw holes 46 of the middle pillar duct member 45 and the screws are inserted through the screw holes.

At this time, the front surface of the top wall 2C, the front surface of the bottom wall 2A and the front surface of the middle pillar 41 are substantially aligned along the same plane, and hence the flanges 45A of the middle pillar duct member 45 are provided so as to abut on the front surface of the middle pillar 41.

Figure 9:
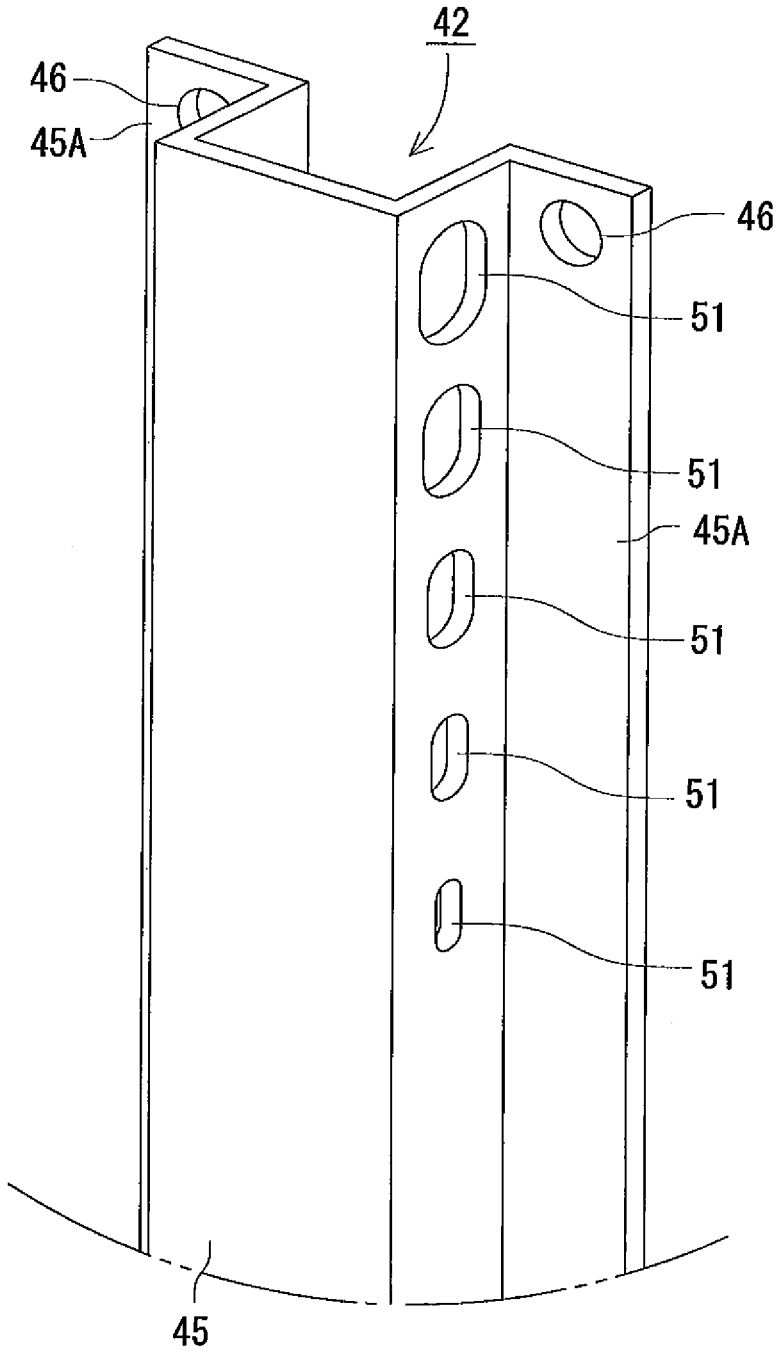
FIG. 9 is an enlarged view of a circular C part of FIG. 2.
Figure 10:
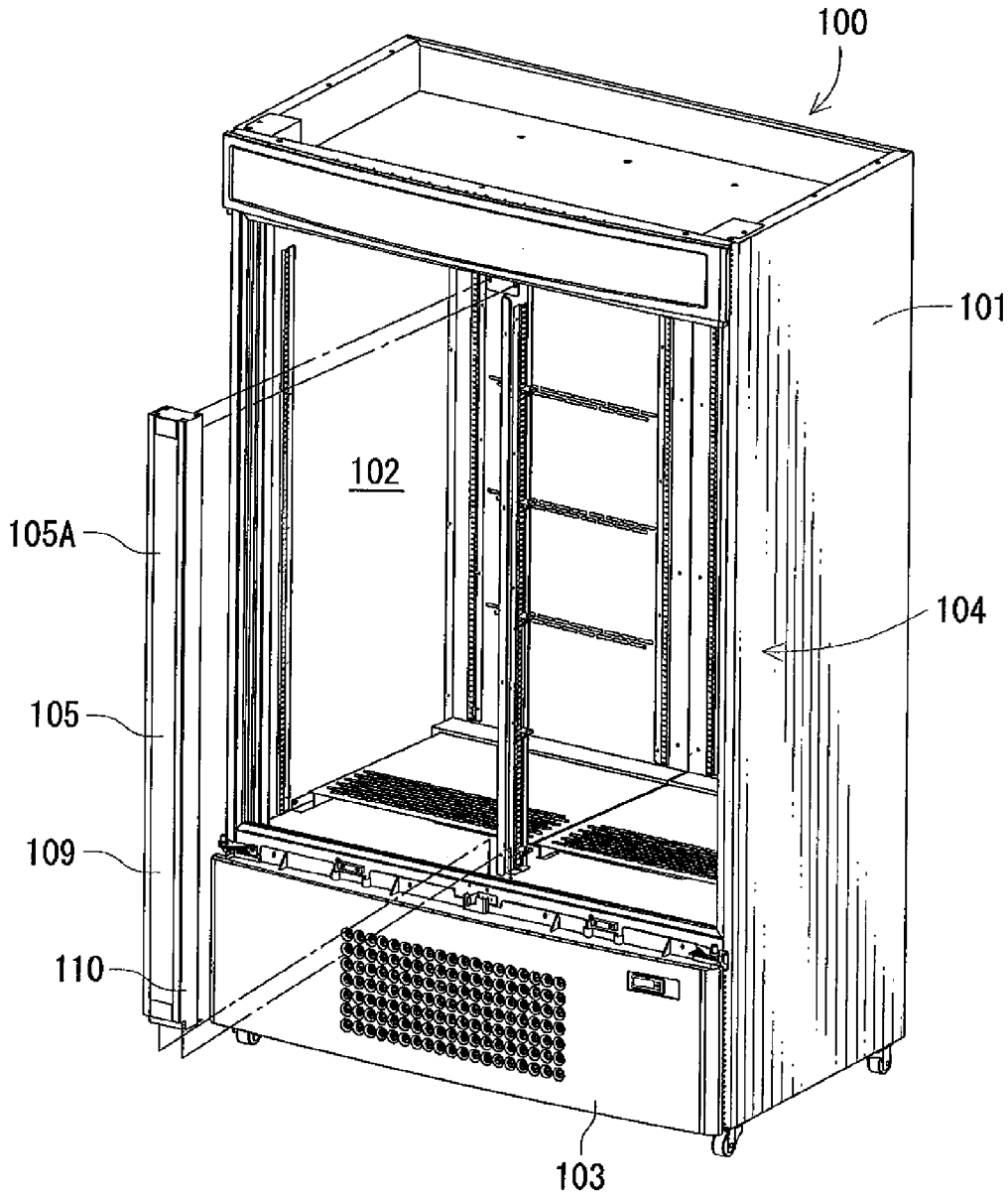
FIG. 10 PRIOR ART
FIG. 10 is a perspective view of a conventional low temperature showcase from which doors are removed.
Figure 11:
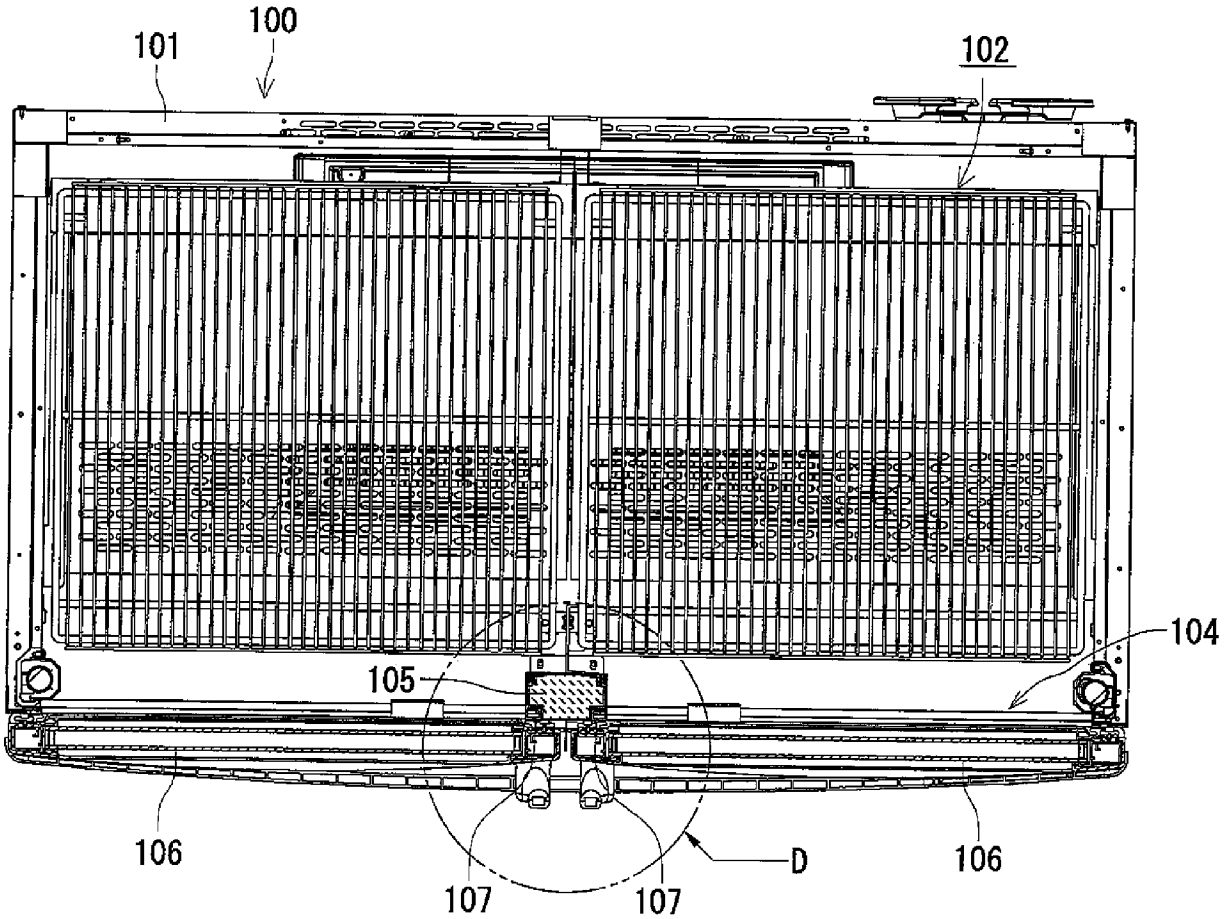
FIG. 11 PRIOR ART
FIG. 11 is a sectional plan view of FIG. 10.
Figure 12:
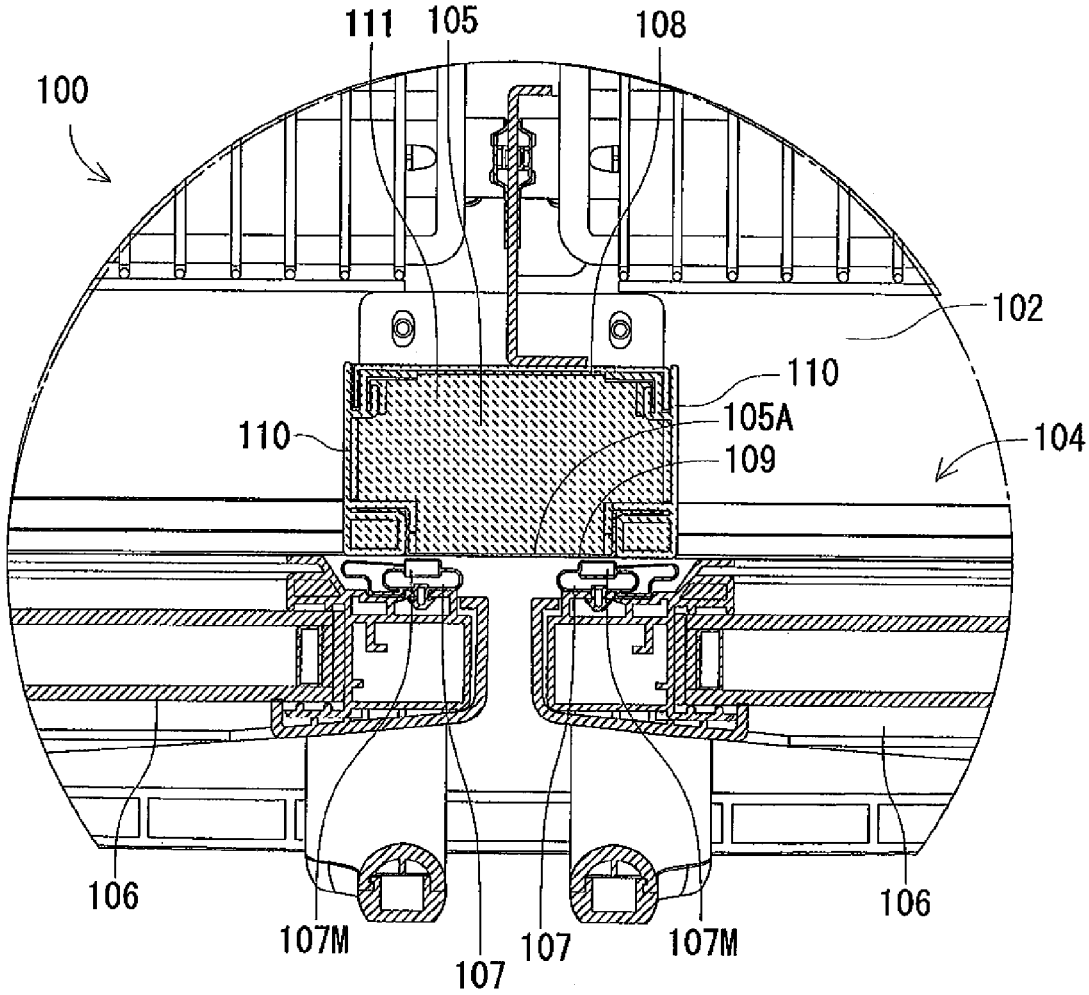
FIG. 12 PRIOR ART
FIG. 12 is an enlarged view of a circular D part of FIG. 11.

Moreover, both side surfaces of the upper part of this middle pillar duct member 45 are provided with a plurality of exhaust holes 51 . . . in a vertical direction. As shown in FIGS. 8 and 9, these exhaust holes 51 are formed so that the open area of the exhaust hole 51 formed on the upside becomes larger than that of the exhaust hole formed on the downside. Furthermore, as shown in FIG. 8, a part of these exhaust holes 51 is formed in a position above the upper side 40A of the gasket 40 of the door 3.

It is to be noted that as shown in FIG. 9, the upper end of the middle pillar duct member 45 may open upwardly, but the present invention is not limited to this example, and an upper wall may be provided to close the upper end.

According to such a constitution, while the doors 3 are closed, the middle pillar duct member 45 is positioned in a gap formed between the rear surface of the door frame 3A and the front surface of the middle pillar 41 in such a state as to avoid the gaskets 40 of the doors 3. Therefore, the middle pillar duct member does not disturb the opening/closing of the doors 3, but the gaskets 40 can abut on both sides of the middle pillar duct member 45 on the front surface of the middle pillar 41, and the middle pillar duct member can closely be attached to the front panel 43 of the middle pillar 41 owing to the magnetic force of the magnet provided in the gasket 40.

According to the above constitution, when the cooling unit R is operated, the cooler 24 in the cooling chamber 23 exerts a cooling function. At this time, when the blower 25 for the cooler is operated, the cold air cooled by the cooler 24 flows upwards through the duct 10 in the main body 2 through the cold air discharge ports 28, 15, and a part of the cold air is discharged from the cold air discharge port 16 to the upper front part of the display chamber 8. As shown by solid-line arrows in FIG. 3, the cold air discharged into the display chamber 8 is discharged to the upper part of the front surface opening 8A, that is, to the upper parts of the doors 3, lowers, circulates through the display chamber 8, and returns into the cooling chamber 23 through the cold air suction ports 14, 27. In consequence, the inside of the display chamber 8 is cooled to a predetermined temperature.

At this time, in the low temperature showcase 1 through which the cold air is circulated, the low-temperature cold air just discharged into the display chamber 8 has the lowest temperature near the door frame 3A of the upper part of each door 3 as shown by one-dot broken line in FIG. 1. Therefore, in such a part, dew condensation easily occurs on the front surface of the middle pillar 41 or the surface of the gasket 40 of the door 3 which comes in contact with outside air.

In the present embodiment, when the fan 35 for the condenser operates, the outside air before the machine chamber 21 first flows into the machine chamber 21 surrounded by the fan case 26 through the suction ports 17 of the machine chamber cover 18, to air-cool the condenser 34. A part of the outside air (warm air) warmed by air-cooling the condenser 34 flows into the exhaust duct 51 formed by the fan case 26 and the bottom wall 2A of the main body 2, and is blown upwardly from the exhaust ports 19 formed horizontally in the upper surface of the machine chamber cover 18 (shown by a black arrow in FIG. 7).

A part of the warm air blown upwardly from the exhaust ports 19 is not diffused in ambient air but flows into the middle pillar duct 42 from the leading portion 50 formed in the middle pillar duct member 45. The warm air flowing upwards through the duct 42 is discharged externally from the gasket 40 between the upper part of the door 3 and the main body 2 (the middle pillar 41) through the respective exhaust holes 51 formed in the upper part of the middle pillar duct member 45.

In the present embodiment, the exhaust holes 51 are formed in both side surfaces of the upper part of the middle pillar duct member 45 received in gaps between the rear surface of the door frame 3A and the front surface of the top wall 2C of the main body 2, the front surface of the middle pillar 41 and the front surface of the bottom wall 2A. Consequently, the warm air can directly be discharged to the gasket 40 of the upper part of each door 3 between the rear surface of the door frame 3A of the door 3 and the main body 2, that is, the upper side 40A of the gasket 40, or the upper portion of the gasket 40 which abuts on the middle pillar 41, and the air can further be discharged externally from corners of the upper side 40A of the gasket 40.

In particular, the low-temperature cold air just discharged into the display chamber 8 is supplied around the door frames 3A of the upper parts of the doors 3 as described above, whereby the front surface of the middle pillar 41 or the surface of each gasket 40 of each door 3 has the lowest temperature around the door frame 3A. In consequence, dew condensation easily occurs. However, the upper portions of the gaskets 40 between the door frames 3A of the door 3 and the main body 2 can directly be heated by the supplied warm air, whereby the dew condensation does not easily occur at the gaskets 40 provided in the upper parts of the doors 3 or on the surface of the middle pillar 41 around the gaskets 40.

Consequently, it is possible to suppress a disadvantage that water droplets attached to the upper parts of the doors 3 fly and scatter to a user or that the surface of the floor is wetted by the water droplets during the opening/closing operation of the doors 3. Moreover, the dew condensation is not easily attached to the surface of the middle pillar 41 in the parts, whereby the closely attaching properties of the middle pillar to the back surface of each door 3 (the gasket 40) can be improved, and the leakage of the cold air from the display chamber 8 can be suppressed.

Moreover, in the present embodiment, the exhaust holes 51 formed in the middle pillar duct member 45 are formed so that the upper exhaust holes 51 have larger open areas. Therefore, the warm air can efficiently be discharged from the upper exhaust hole which is disposed apart from the machine chamber 21 and which cannot easily be reached by the warm air. In consequence, the dew condensation does not easily occur effectively on the gaskets 40 provided in the upper parts of the doors 3, or the surface of the middle pillar 41 around the gaskets 40.

Furthermore, in the present embodiment, since the middle pillar duct member 45 is provided on the front surface of the middle pillar 41, the middle pillar duct member 45 provided on the front surface of the middle pillar 41 can be heated by heat conducted from the warm air discharged from the fan 35 for the condenser and flowing upwards through the middle pillar duct 42.

In consequence, the dew condensation does not easily occur on the surface of the middle pillar duct member 45 which comes in contact with outside air in the vertical direction. Therefore, the dew condensation does not easily occur on the gaskets 40 of the doors 3 which abut on the front surface of the middle pillar duct member 45, and it is possible to suppress a disadvantage that fingers are wetted during the opening/closing operation of the doors 3 or that the surface of the floor is wetted by the water droplets attached to the back surfaces of the doors. Moreover, dew condensation water is not easily attached to the surface of the middle pillar 41, whereby the closely attaching properties of the front surface of the middle pillar 41 to the gaskets 40 of the doors 3 can be improved, and the leakage of the cold air from the display chamber 8 can be suppressed.

Moreover, since the leading portion 50 provided on the lower end of the middle pillar duct member 45 is formed so as to correspond to the exhaust ports 19 formed in the machine chamber cover 18, the warm air from the machine chamber 21 can efficiently be led into the middle pillar duct 42 without providing any special means for guiding the warm air from the machine chamber 21.

It is to be noted that in the above constitution, the middle pillar duct 42 can be formed by attaching the middle pillar duct member 45 to the front surface of the middle pillar provided in the existing showcase, and hence the present invention can be realized without changing the design of the middle pillar.

What is claimed is:

1. A low temperature showcase including a display chamber disposed in a main body made of an insulating wall; doors which have gaskets closely attached to the opening edge of the front surface of the display chamber and which openably close the opening of the front surface of the display chamber; a middle pillar which is provided in the opening of the display chamber and a front surface of the middle pillar abuts on the gaskets of the doors; a machine chamber disposed outside the insulating wall under the display chamber; and a cooling unit constituted of a compressor, a condenser, a fan for the condenser arranged in the machine chamber, the showcase including:

a middle pillar duct member which is vertically attached to the middle pillar and in which a middle pillar duct is defined;

a leading portion which leads air discharged from the fan for the condenser into the middle pillar duct; and exhaust holes which discharge the air flowing upwards through the middle pillar duct to the outside of the gaskets between the upper part of the doors and the main body, wherein the exhaust holes provided in the middle pillar duct member comprise upper exhaust holes and lower exhaust holes, and the upper exhaust holes have larger open areas than the lower exhaust holes.

2. The low temperature showcase according to claim 1, wherein the middle pillar duct member is provided on the front surface of the middle pillar.

* * * * *